US010731637B2

(12) United States Patent
Walmsley et al.

(10) Patent No.: US 10,731,637 B2
(45) Date of Patent: Aug. 4, 2020

(54) PORTABLE PUMP

(71) Applicant: WALMSLEY DEVELOPMENTS PTY LTD, Victoria (AU)

(72) Inventors: Byron Walmsley, Victoria (AU); Albert Walmsley, Westeran Australia (AU); Roland Walmsley, Westeran Australia (AU)

(73) Assignee: WALMSLEY DEVELOPMENTS PTY LTD, Victoria (AU)

( * ) Notice: Subject to any disclaimer, the term of this patent is extended or adjusted under 35 U.S.C. 154(b) by 185 days.

(21) Appl. No.: 15/750,130

(22) PCT Filed: Jul. 26, 2016

(86) PCT No.: PCT/AU2016/050666

§ 371 (c)(1),
(2) Date: Feb. 2, 2018

(87) PCT Pub. No.: WO2017/015711

PCT Pub. Date: Feb. 2, 2017

(65) Prior Publication Data

US 2019/0003468 A1 Jan. 3, 2019

(30) Foreign Application Priority Data

Jul. 27, 2015 (AU) ..... 2015902982

(51) Int. Cl.
*F04B 35/06* (2006.01)
*F04B 39/12* (2006.01)
(Continued)

(52) U.S. Cl.
CPC ..... *F04B 35/06* (2013.01); *F04B 35/04* (2013.01); *F04B 39/06* (2013.01); *F04B 39/064* (2013.01);
(Continued)

(58) Field of Classification Search
CPC ..... F04B 35/04; F04B 35/06; F04B 39/0094; F04B 39/121; F04B 49/022; F04B 39/06
See application file for complete search history.

(56) References Cited

U.S. PATENT DOCUMENTS 1,187,031 A * 6/1916 Black ..... F04B 35/06 417/234
1,647,818 A * 11/1927 Semak ..... B60S 5/046 417/419

(Continued)

FOREIGN PATENT DOCUMENTS

EP 689645 B1 12/1997
EP 1605162 A2 12/2005

(Continued)

OTHER PUBLICATIONS

International Preliminary Report on Patentability dated Mar. 27, 2017 in International Patent Application No. PCT/AU2016/050666, 33 pages.

(Continued)

*Primary Examiner* — Peter J Bertheaud
(74) *Attorney, Agent, or Firm* — Shook, Hardy & Bacon L.L.P.

(57) ABSTRACT

A portable pump is provided including an electric motor having a drive shaft connected to a gear assembly to drive a reciprocating air compressor arrangement. The reciprocating air compressor arrangement includes a crank that drives a connecting rod and a piston within a cylinder. The connecting rod has a first end and a second end and the first end of the rod is connected to the crank while the second end of the rod connected to the piston (to drive the piston in the cylinder and provide compression). The second end of the connecting rod is connected to the piston via a pin. The piston includes a sealing arrangement. A control unit is provided which is in electrical communication with the (Continued)

electric motor and the air compressor to control the operation of the pump arrangement. A power supply is also provided in electrical communication with the control unit to supply power to the control unit and electric motor. The pump is provided within a housing which accommodates the electric motor, the gear assembly, the reciprocating air compressor, the control unit and the power supply. A outlet connected to the reciprocating air compressor is also provided so as to engage with an object to be pumped.

14 Claims, 5 Drawing Sheets

(51) Int. Cl.

| | |
|---|---|
| ***F04B 39/06*** | (2006.01) |
| ***F04B 35/04*** | (2006.01) |
| *F04B 49/06* | (2006.01) |
| *F04B 39/04* | (2006.01) |

(52) U.S. Cl.
CPC ..... *F04B 39/121* (2013.01); *F04B 39/042* (2013.01); *F04B 39/125* (2013.01); *F04B 49/06* (2013.01); *F04B 2205/03* (2013.01); *F04B 2205/11* (2013.01)

(56) References Cited

U.S. PATENT DOCUMENTS

| | | | | | |
|---|---|---|---|---|---|
| 2,960,321 | A * | 11/1960 | Stoots, Jr. | A01K 63/042 | 261/30 |
| 3,243,100 | A * | 3/1966 | Adams | A61M 16/0057 | 137/565.18 |
| 4,033,511 | A * | 7/1977 | Chamberlin | B05B 7/2416 | 239/346 |
| 4,080,105 | A | 3/1978 | Connell | | |
| 4,396,363 | A * | 8/1983 | Sakamaki | F04B 39/1073 | 417/439 |
| 4,556,478 | A * | 12/1985 | Shioiri | B01J 29/06 | 208/120.2 |
| 4,601,235 | A * | 7/1986 | Roberts | F04B 53/143 | 277/437 |
| 4,715,787 | A | 12/1987 | Hung | | |
| 4,776,766 | A * | 10/1988 | Brent | F04B 33/00 | 137/224 |
| 4,789,310 | A * | 12/1988 | Hung | A47L 5/24 | 15/339 |
| 5,125,800 | A * | 6/1992 | Wong | G05D 16/2066 | 417/26 |
| 5,127,808 | A | 7/1992 | Nichols et al. | | |
| 5,370,504 | A | 12/1994 | Nagashima | | |
| 5,395,216 | A | 3/1995 | Lin | | |
| 5,639,226 | A | 6/1997 | Boutrup et al. | | |
| 6,095,762 | A | 8/2000 | Wheeler | | |
| 6,132,177 | A | 10/2000 | Loprete et al. | | |
| 6,439,104 | B1 | 8/2002 | Tonogai et al. | | |
| 6,524,082 | B2 | 2/2003 | Morita et al. | | |
| 6,629,827 | B2 * | 10/2003 | Chou | F04B 35/04 | 417/368 |
| 7,017,342 | B2 * | 3/2006 | Iimura | F04B 41/02 | 60/329 |
| 9,777,718 | B2 | 10/2017 | Wang | | |
| 2001/0022939 | A1 | 9/2001 | Morita et al. | | |
| 2005/0047947 | A1 | 3/2005 | McCombs et al. | | |
| 2006/0002800 | A1 | 1/2006 | Klein et al. | | |
| 2006/0140791 | A1 | 6/2006 | Deming et al. | | |
| 2007/0264139 | A1 | 11/2007 | Chou | | |
| 2015/0322935 | A1 | 11/2015 | Wang | | |
| 2015/0337825 | A1 | 11/2015 | Chou | | |

FOREIGN PATENT DOCUMENTS

| | | | |
|---|---|---|---|
| EP | 3418567 | A1 | 12/2018 |
| WO | 0129421 | A1 | 4/2001 |
| WO | 02057630 | A1 | 7/2002 |
| WO | 2004068693 | A2 | 8/2004 |
| WO | 2010001427 | A1 | 1/2010 |
| WO | 2015007405 | A1 | 1/2015 |
| WO | 2017015711 | A1 | 2/2017 |

OTHER PUBLICATIONS

Extended search report dated Sep. 18, 2018 in European Patent Application No. 18178860.5, 8 pages.
Extended search report dated Dec. 20, 2018 in European Patent Application No. 16829498.1, 8 pages.
Communication pursuant to Rule 114(2) Third Party Observations dated Nov. 11, 2019 in European Patent Application No. 18178860.5, 8 pages.
Communication pursuant to Rule 114(2) Third Party Observations dated Nov. 5, 2019 in European Patent Application No. 16829498.1, 8 pages.

* cited by examiner

PORTABLE PUMP

CROSS-REFERENCE TO RELATED APPLICATIONS

This application claims priority under 35 U.S.C. § 365 to PCT/AU2016/050666, filed on Jul. 26, 2016, entitled "PORTABLE PUMP," which claims priority to Australian App. No. 2015902982 filed on Jul. 27, 2015, the entirety of the aforementioned applications are incorporated by reference herein.

TECHNICAL FIELD

The present invention relates to a portable, hand-held pump and in particular a pump for filling objects with gases such as air.

BACKGROUND OF INVENTION

Pumps which are used to fill objects to a high pressure typically incorporate reciprocating air compressors. These types of compressors tend to be large and heavy in size and require an external power supply. This in turn makes such pumps difficult to transport and less useful if an external power supply is not readily available.

While some pumps may obtain external power via an AC or DC power source (for example from a wall socket or car battery), these compressors are still quite bulky and weigh upwards of 1.5 kilograms and are therefore not particularly portable.

The above problems are exasperated for cyclists who require portability, who may or may not have access to a power supply and who are also concerned about the weight of a pump. While some cyclists use carbon dioxide canisters (known as $CO_2$ inflators), these canisters have a number of disadvantages and that they are intended for one use only. Another problem is that they become very cold during use and may expose a user to potential burns. On the other hand, traditional manual hand pumps are light weight but are slow to use in that it takes a large amount of time to inflate a tyre. It is also difficult to achieve pressures of above 80 psi using the manual hand pumps that are designed to be mounted to the bicycle frame.

While some portable, battery powered air pumps do exist, they tend to be sized relatively large, of substantial weight, and designed to be standalone. There is an inherent difficulty in providing a pump mechanism which is small, battery powered, hand-held and able to provide sufficient pressure to fill an object, whilst at the same time dissipating the heat generated during the air compression process. Portable pumps currently available have large surface areas and often utilise bulky heat sinks to dissipate the heat. The heat must be dissipated during the compression process otherwise the compressor's efficiency will be reduced, as well as causing detrimental effects to the seals located inside the compressor. This heat dissipation process however makes it very difficult to design a hand-held pump due to the heat transferred from the pump to the hand of the user during use.

It would therefore be desirable to provide a pump which ameliorates or at least alleviates the above problems or provides alternatives.

Before turning to a summary of the present invention, it will be appreciated that the discussion of the background to the invention is included to explain the context of the invention. This is not to be taken as an addition that any of the material referred to is published, known or part of the common general knowledge.

SUMMARY OF INVENTION

The present invention improves on past approaches as its design has been optimised for use as a portable, hand-held device. The pump of the present invention is small enough to fit into a user's hand, yet powerful enough to pump up a number of different types of objects including, for example, a typical racing bike tire up to 120 psi in less than 1 minute, yet weighing less than 350 grams. Advantageously, the size of the pump allows for it to be placed into a bicycle's saddle bag or frame, placed into a user's backpack, or inside a car's glove box without detriment to the user.

According to a first aspect, the present invention provides, a portable pump including: an electric motor having a drive shaft, the drive shaft connected to a gear assembly to drive a reciprocating air compressor arrangement; the reciprocating air compressor arrangement including: a crank that drives a connecting rod and a piston within a cylinder, the connecting rod having a first end and a second end, said first end of the rod connected to the crank and said second end of the rod connected to the piston to drive the piston in the cylinder and provide compression; said piston including a sealing arrangement; and wherein the second end of the connecting rod is connected to the piston via a pin; a control unit in electrical communication with the electric motor and the air compressor to control the operation of the pump arrangement; a power supply in electrical communication with the control unit to supply power to the control unit and electric motor; a housing which accommodates the electric motor, the gear assembly, the reciprocating air compressor, the control unit and the power supply; and an outlet connected to the reciprocating air compressor so as to engage with an object to be pumped.

The present invention has a two-piece connecting rod and piston arrangement located inside the reciprocating air compressor. The arrangement allows the length of the connecting rod to be reduced whilst the seals of the piston maintain sufficient contact with the walls of the cylinder during travel up and down the cylinder.

Preferably, the piston further includes a sealing arrangement that includes an upper compression seal and a lower stabilising seal. The upper compression seal acts as a compression seal and ensures compressed air stays above the top of the piston and the lower stabilising seal stabilises the piston. This arrangement ensures that no part of the piston comes into contact with the walls of the cylinder. Advantageously, this allows the cylinder to be manufactured from soft, lightweight materials such as aluminium or magnesium components (as opposed to carbon steels, low alloy steels or other ferrous containing materials) thereby greatly reducing the weight of the compressor. The design is also more tolerant to dimensional variations of the piston, thereby allowing for cheaper manufacturing methods such as casting to be utilised. The piston seal arrangement also does not require lubrication; therefore the compressor can run without an oil bath. The sealing arrangement may incorporate seals that are cup-shaped, cylindrical-shaped or may include an O-ring arrangement with variations in cross sections, in combination with the piston.

Preferably, the connecting rod has a length L and the stroke angle has a value δ, the length L ranging from 20-30 mm and a corresponding stroke angle ranging from 10 to 20 degrees.

Preferably, the power supply is a rechargeable battery, which may include, but is not limited to, lithium polymer or lithium-ion or the like. Advantageously, the present invention makes use of a rechargeable lithium-polymer battery since these batteries have much greater energy densities than typical nickel-cadmium and nickel-metal-hydride rechargeable batteries. As the electrolytes are gelled, the packaging of these batteries is greatly simplified making them extremely lightweight. Advantageously, these batteries are also easy to recharge through use of an external power source such as a wall adaptor. This means the batteries do not need to be removed from the unit to recharge them.

Preferably, the electric motor is a brushless DC motor, as opposed to brushed DC motors commonly found in typical air pumps. Advantageously, brushless DC motors have much higher torque-to-weight ratios compared to conventional brushed DC motors, therefore allowing for a smaller sized (and hence lighter) motor to be used, whilst still providing enough torque to drive the compressor.

Preferably, the housing is made from a high strength, thermally conductive material such as aluminium and the housing is in contact with a portion of the pump's compressor thereby acting as a heat sink. It does this by removing heat from the compressor via conduction. This arrangement adds negligible weight to the compressor whilst increasing the compressor's run time and duty cycle. Using a high strength material such as aluminium, as opposed to low strength materials such as plastics, allows the housing to be manufactured with thin walls, thereby reducing the overall size of the pump. A material such as aluminium also has superior fatigue properties compared to plastic materials, which means the housing has less chance of cracking during prolonged use.

Preferably, the pump includes a temperature sensor and a pressure sensor that are electrically connected to the control unit. The control unit monitors the temperature and pressure of the compressor and shuts off power to the compressor in the event that a predetermined temperature or pressure value is exceeded. The use of a temperature and pressure sensor ensures safe use of the pump which is important when considering it is a hand-held device.

DETAILED DESCRIPTION

Figure 1:
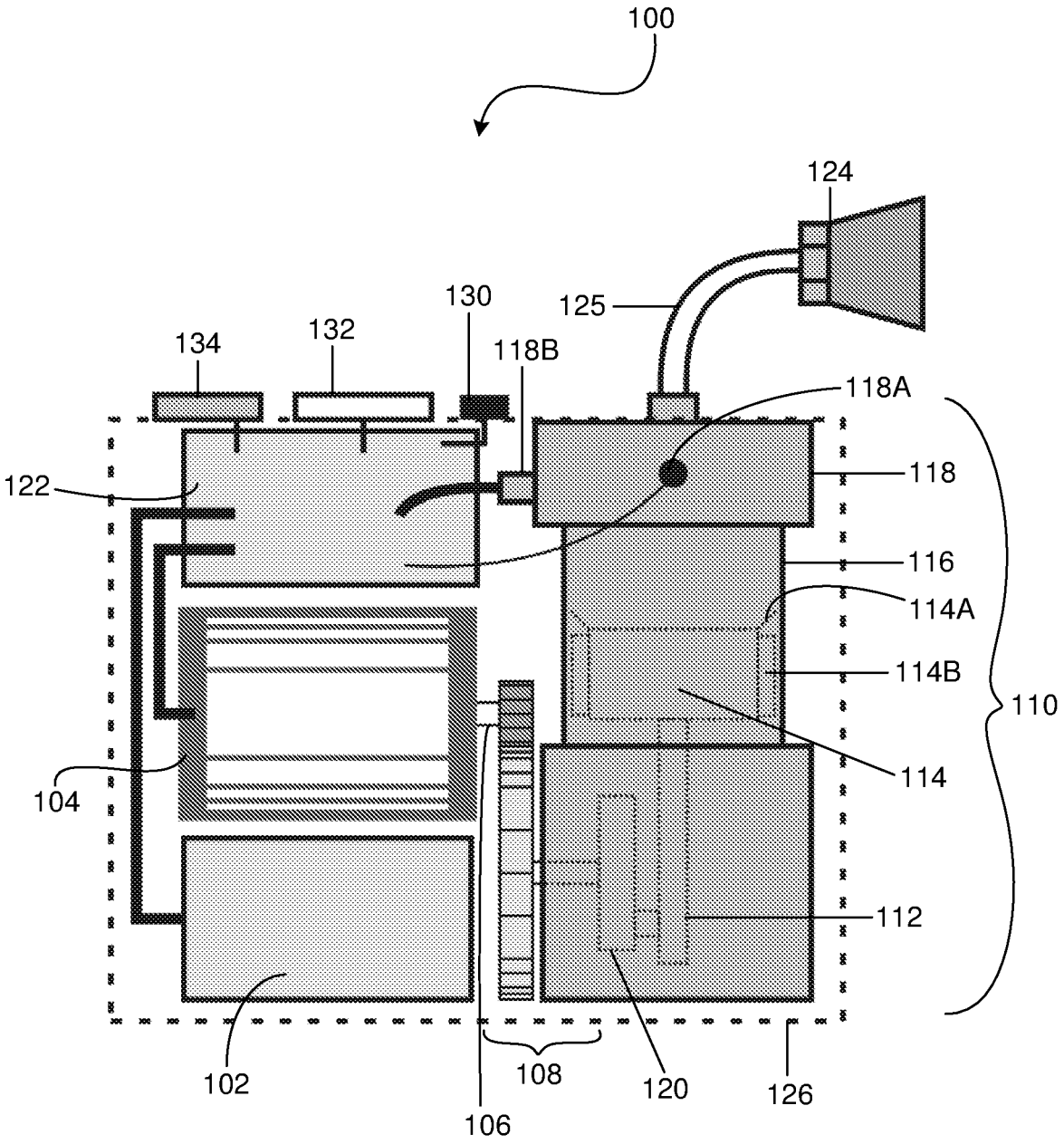
FIG. 1 is a schematic side view of the portable pump according to the present invention.

FIG. 1 is a schematic side view of a portable pump 100 according to the present invention. The portable pump 100 includes a power supply 102, an electric motor 104 having a drive shaft 106 that connects to a gear assembly 108 that drives a reciprocating air compressor 110. A control unit 122 is provided which is in electrical communication with the electric motor 104, and the power supply 102. The control unit 122 also takes temperature and pressure readings of the compressor via sensors located on the compressor 118. The power supply 102, electric motor 104, drive shaft 106, gear assembly 108, reciprocating air compressor 110 and control unit 122 are all contained within a housing 126.

The control unit 122 may be a printed circuit board which consists of control circuitry that handles user inputs as well as monitoring the compressed air pressure in the reciprocating air compressor 110 together with the temperature of the reciprocating air compressor 110. The control unit 122 also controls the electric motor 104 via circuitry that turns the motor on and off when prompted by the user. The portable pump 100 also preferably includes a power switch control 130 for turning on and off the portable pump 100, a display 132 for displaying the current pressure of the object to be filled and or the current status of the portable pump 100. Also provided is a further switch 134 which may be used to actually operate the pump so when the further switch 134 is not engaged, the pump 100 stops operating.

The reciprocating air compressor 110 includes a number of components which allow for the portable pump 100 to be portable in size. The reciprocating air compressor 110 includes a cylinder 116, as well as a piston 114 connected to a connecting rod 112 which is connected to a crank 120 which is driven by the gear assembly 108. The piston 114 preferably further includes an upper compression seal 114A and lower stabilising seal 114B. The reciprocating air compressor 110 also includes a head 118 which contains a temperature sensor 118A and a pressure sensor 1186 which feeds temperature and pressure data from the head 118 to the control unit 122.

In operation, the portable pump 100 is turned on by a user via switch 130. Once turned on, gauge pressure measured by a sensor 1186 in the compressor head 118 is presented to the user via the display 132. This way the user can immediately determine what pressure the object to be filled is currently at. The pump 100 then may be actuated by the user via switch 134 such that when switch 134 is triggered, the electric motor 104 starts running which in turn rotates the drive shaft 106 and in turn the gear assembly 108, crank 120 and connecting rod 112 which in turn actuates the piston 114 located inside the cylinder 116. One-way valves [not shown] located on the top surface of the piston 114 as well as inside the compressor head 118 ensure air is compressed inside the cylinder 116 and forced through the outlet 124 via high pressure hose 125. This process is carried out many times a second as the piston 114 traverses up and down the inside of the cylinder 116.

Advantageously the arrangement of the portable pump 100 of the present invention is small in dimension due to the connecting rod 112 and piston 114 arrangement. In typical air compressors there is a one piece connecting rod and piston such that there is no point about which the piston 114 can pivot on the rod 112. This results in this arrangement requiring the piston 114 to lean from side to side as the eccentric journal on the crank 120 moves the piston 114 up and down. These arrangements typically have a deformable seal located at the top of the piston 114 so as to maintain contact with the cylinder walls and prevent air leakage. Seals of this type are typically manufactured from polytetrafluoroethylene (PTFE, also known as Teflon™), in the shape of a cup and include additives such as bronze to provide enough lubrication to the seal so that it does not require additional lubrication such as oil. This particular arrangement is utilised in existing portable pumps largely due to it not requiring an oil bath, as well as its simplicity, ease of manufacture and low cost.

A disadvantage of this arrangement is that there are dimensional constraints placed on a length of the connecting rod 112. If the length of the connecting rod 112 is too small, the stroke angle becomes too large and the seal cannot maintain good contact with the cylinder wall during each stroke. So by necessity, the length of the connecting rod 112 must be large and this impacts on the size of the pump.

Other arrangements make use of a two piece connecting rod and piston but requires a complex sealing arrangement that includes one or more compression rings and an oil ring. The compression rings maintain air compression above the piston and the oil ring keeps lubricating oil away from the compressed air. This arrangement is expensive, complex to manufacture and assemble, and requires an oil bath to maintain lubrication.

Figure 2A:
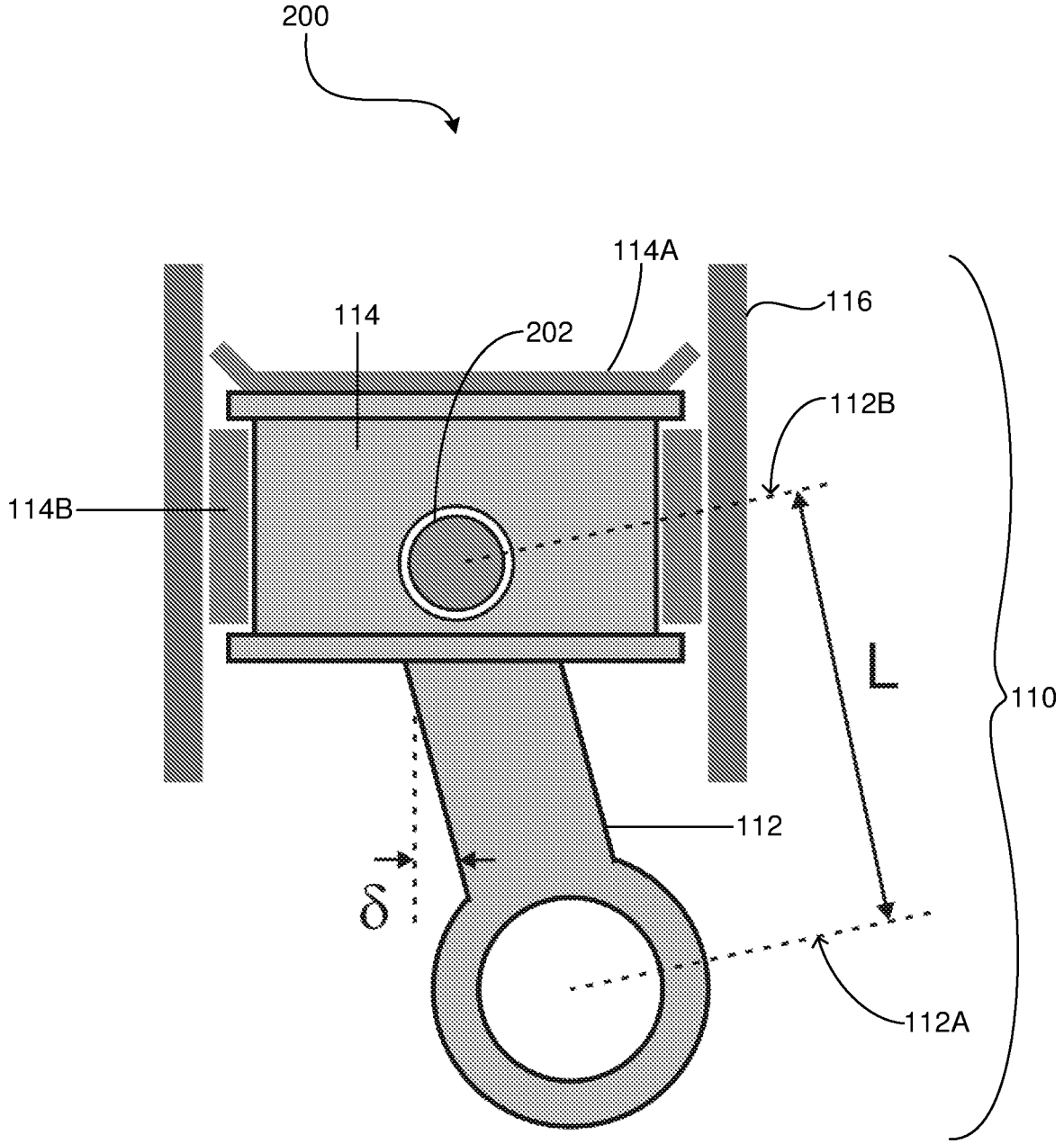
FIG. 2*a* is a schematic diagram illustrating the arrangement of the connecting rod, piston and sealing arrangement according to the invention.

FIG. 2*a* is a schematic diagram 200 of the reciprocating air compressor 110 having a connecting rod 112, piston 114 and cylinder 116 of the reciprocating air compressor 110 of FIG. 1. The connecting rod 112 includes a first end 112A and a second end 112B. The first end 112A is connected to the crank 120 and the second end 112B is connected to the piston 114 via a pin 202. The distance between the first end 112A of the connecting rod 112 and the second end 1126 of the connecting rod 112 is the length L of the connecting rod 112. The connecting rod 112 moves in a circular motion as the piston 114 moves up and down the cylinder 116 and the angle through which the connecting rod 112 moves is known as the stroke angle δ. A sealing arrangement is provided in the form of an upper compression seal 114A and lower stabilising seal 114B. Upper compression seal 114A and lower stabilising seal 114B are provided at the first and second ends of the piston 114 and upper compression seal 114A is oriented such that it provides minimal resistance to the cylinder 116 on the downstroke but maintains maximum compression of air above the piston 114 on the upstroke.

Upper compression seal 114A and lower stabilising seal 114B may be manufactured from materials such as PTFE. Upper compression seal 114A is cupped around the piston in the shape shown in FIG. 2*a*. This shape allows the seals to deform towards the walls of the cylinder during the upstroke of the piston, when a positive pressure differential is experienced by the seal on its top surface during the air compression process. Lower stabilising seal 114B is cylindrical in shape and ensures piston 114 remains vertical during actuation. The seals may further include additives such as bronze to provide enough lubrication to the seals so that they do not require additional lubrication such as oil. It will be appreciated however that the cross sections of the seals may take any suitable shape and may be modified depending on the application of the pump. The stabilizing seal, for example, could be an "O-ring" type of arrangement namely the ring seated in a recess having a square, rectangular, circular or other variation in cross section. The stabilizing seal could also consist of multiple, smaller-sized seals in an arrangement that reduces the contact area against the walls of the cylinder, whilst still stabilizing the piston. Alternative cross sections could also be used for the upper compression seal, however the inventors have found that a cup-shaped seal is simpler to install and tends to run more efficiently.

Advantageously, the arrangement of FIG. 2*a* allows the length L of the connecting rod 112 to be manufactured shorter and therefore reducing the overall size of the reciprocating air compressor 110. The design is also more tolerant to dimensional variations of the piston 114, thereby allowing for cheaper manufacturing methods such as casting to be utilised. Since there is no chance of the piston 114 and cylinder 116 coming into contact (by way of the upper compression seal 114A and lower stabilizing seal 114B) these parts can be manufactured using softer materials such as aluminium or magnesium, which further reduces the weight of the pump.

Advantageously, the sealing arrangement in FIG. 2*a*, namely providing an upper compression seal 114A and a lower stabilizing seal 114B in the arrangement as shown in FIG. 2*a*, ensures all moments of the piston 114 are balanced ensuring parallel motion of the piston 114 relative to the cylinder 116 during each stroke.

Figure 2B:
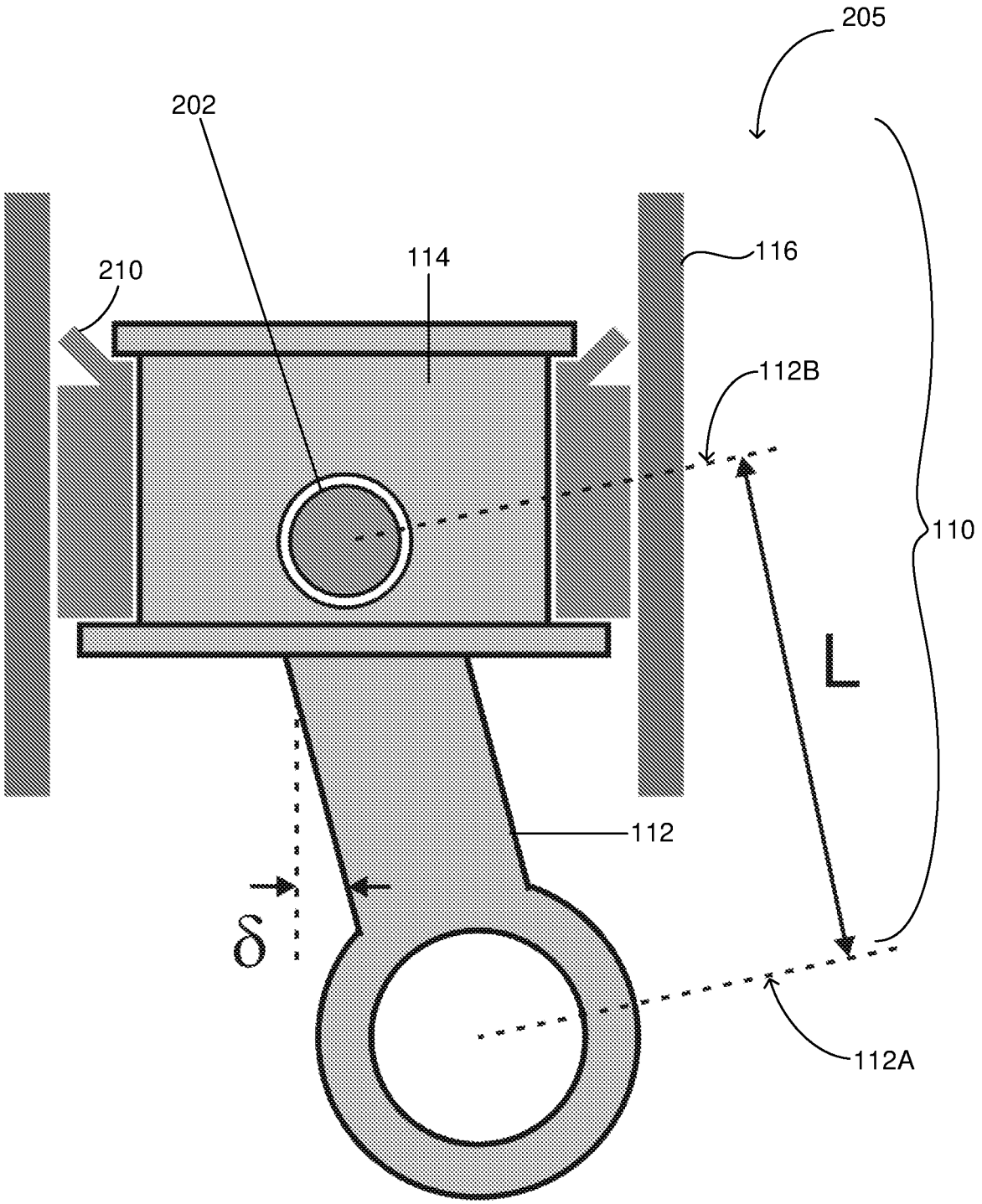
FIG. 2*b* is a schematic diagram illustrating the arrangement of the connecting rod, piston and an alternative sealing arrangement according to the invention.

FIG. 2*b* is a schematic diagram 205 of the reciprocating air compressor 110 having an alternative sealing arrangement which may be utilized. In this sealing arrangement, a single seal 210 replaces the upper compression seal and lower stabilizing seal of FIG. 2*a*. The air compressor 110 has a connecting rod 112, piston 114 and cylinder 116 of the reciprocating air compressor 110 of FIG. 1. The connecting rod 112 includes a first end 112A and a second end 112B. The first end 112A is connected to the crank 120 and the second end 112B is connected to the piston 114 via a pin 202. The distance between the first end 112A of the connecting rod 112 and the second end 112B of the connecting rod 112 is the length L of the connecting rod 112. The connecting rod 112 moves in a circular motion as the piston 114 moves up and down the cylinder 116 and the angle through which the connecting rod 112 moves is known as the stroke angle δ. A sealing arrangement is provided in the form of seal 210. Seal 210 extends around the wall 116 of the cylinder and is oriented such that it provides minimal resistance to the cylinder 116 on the downstroke but maintains maximum compression of air above the piston 114 on the upstroke.

The seal 210 may be manufactured from materials such as PTFE. Seal 210 forms a cylindrical shape around the piston, and acts as both a compression seal and a stabilizing seal. Advantageously, this arrangement is simpler to assemble, however the complexity of the seal's cross section would require more stringent manufacturing processes to produce accurately.

The design of the present invention has been optimised so that it can be run for extended periods without temperatures increasing too high. This is achieved using the housing 126 which is made from thermally conductive material. The positioning and orientation of the housing relative to the head of the compressor 118 is of importance since the air compression process generates heat in the head of the compressor 118. In the event that the heat is not dissipated fast enough, then the length of time that the pump 100 can be safely run for is reduced as well as the duty cycle of the pump 100. While these issues can be overcome by designing compressor heads with cooling fins or including a cooling fan, the use of a cooling fan and/or cooling fins adds both to the size and weight of the pump.

Advantageously, the present invention provides a housing 126 which is utilised as a heat sink and is made from high strength, highly thermally conductive light weight material such as aluminium. Preferably the casing is manufactured by either using sheet metal or extrusion processes.

Figure 3:
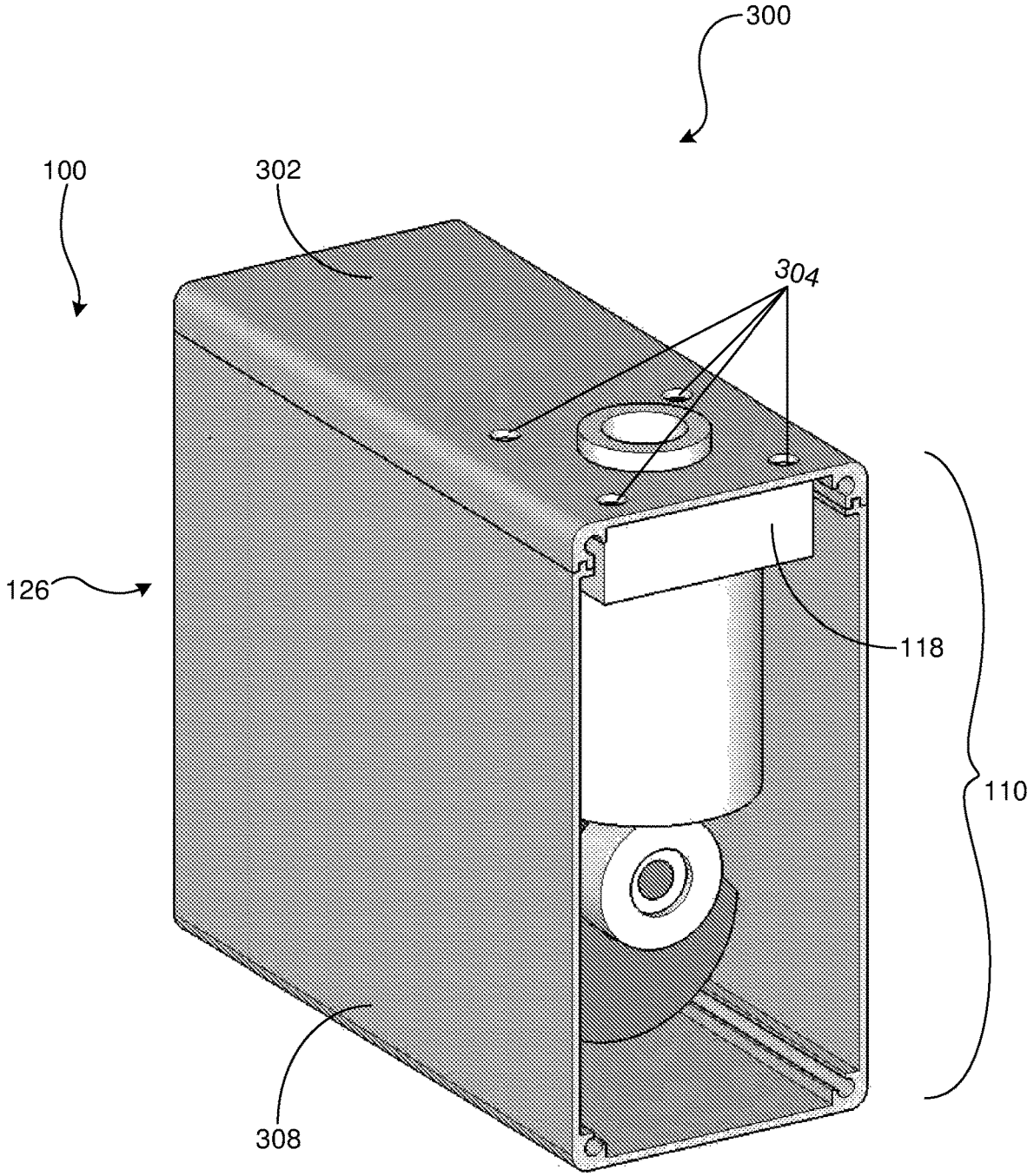
FIG. 3 is a perspective schematic diagram of the portable pump of FIG. 1.

FIG. 3 is a schematic isometric view 300 of a pump 100 in which a housing 126 is provided. The housing 126 is preferably 0.9 to 1.5 millimetre thick aluminium manufactured using extrusion methods. The housing 126 includes an upper component 302 and a lower component 308 and the head of the compressor 118 is mounted directly to the upper component 302 of the housing 126 via four mounting screws 304. The upper component 302 is mounted onto the lower component 308, and therefore they are thermally connected.

Since the surface area of the combined upper component 302 and lower component 308 is large compared to the compressor dimensions they will adequately work as a heat sink, therefore drawing heat away from the reciprocating air compressor 110. In this arrangement, the inventor has found that the temperature of the compressor head 118 is reduced by up to 25% during operation and the duty cycle of the pump is increased by up to 50%.

The housing 126 is preferably a high strength, light weight and thermally conductive enclosure which may, for example, be made from aluminium. It will be appreciated that other materials made be used to manufacture the housing. Due to its excellent thermal conductivity, thin gauge copper sheeting could be used. From a cost effective standpoint, a housing manufactured from steel sheet metal could be adequate for pumps that only require shorter run times. For pumps that need to be extremely lightweight, the housing could be manufactured from magnesium.

It will also be appreciated that other housing arrangements could be utilised. For the housing arrangement shown in FIG. 3, an upper and a lower housing component were utilised. The housing however could easily be manufactured from the one component, or from two or more components arranged in a different manner, provided one or more of the components are in thermal connection with the compressor so that the combined components act as a heat sink for the compressor.

During operation of the pump 100, the temperature of the compressor head 118 is continually monitored through the use of a temperature sensor 118A and a pressure sensor 118B that are in electrical connection to the control unit 122 such that if continual operation of a pump 100 leads to the temperature and/or pressure of the head 118 reaching a value greater than a predetermined critical value, the control unit will shut down the pump 100. The user may then be notified of the event via display 132. This process is particularly important considering the pump 100 is a hand-held device. The predetermined critical value must be low enough to ensure that the pump 100 does not get too hot during use, otherwise it could burn the user's hand. The critical value however must not be set too low otherwise the pump 100 will shut down before it manages to pump up the object that requires filling. Therefore, it is advantageous to design the housing such it its surface area is large enough so as to maximise heat transfer away from the head of the compressor, and for it to remain cool enough so that it does not burn the user's hand.

It will also be appreciated that other temperature sensor arrangements could be utilised. During operation of the pump 100 the cylinder 116 and housing 126 also experience increases in temperature. Therefore, temperature sensor 118A could be mounted onto either of these components. The inventors however have found that mounting the temperature sensor directly onto the head of the compressor produces the most reliable results as the head of the compressor is one of the first aspects that is heated during the compression process.

The control unit 122 may also include a voltage sensor [not shown] which continually monitors the voltage of the power supply 102 so that in the event the power supply 102 drops below a predetermined critical value, the control unit 122 will shut the pump 100 down so as to ensure safe operation of the power supply 102 and prolong the life of the power supply 102.

Figure 4:
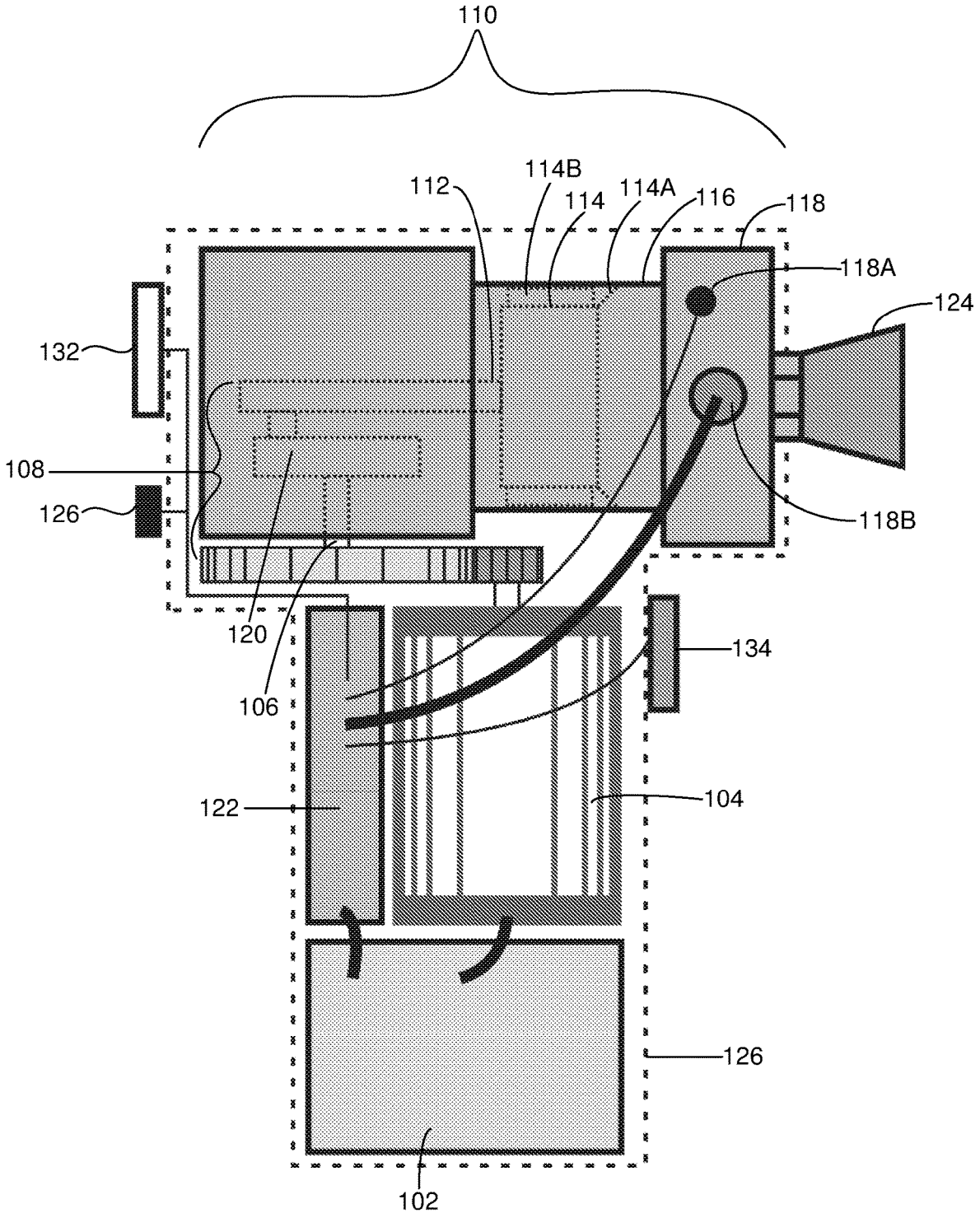
FIG. 4 is schematic diagram illustrating an alternative configuration of the portable pump of the present invention.

FIG. 4 is an alternative arrangement of a pump 100 according to the present invention in which the arrangement of the pump is modified such that the reciprocating air compressor 110 is provided above the power supply 102 and the control unit 122 whereby the user can turn the pump 100 on with their thumb using switch 130 whilst actuating the pump using switch 134 and avoiding the need for the high pressure hose 125 shown in FIG. 1 and instead just utilising the outlet 124.

Preferably the pump 100 is sized so that it fits more ergonomically into the hand of a user. Dimensions of the pump may be as follows but are not limited to these dimensions: The cylinder 116 has a diameter between 10 and 40 millimetres and a length between 15 and 35 millimetres. The reciprocating air compressor 110 has a total height of between 60 and 80 millimetres and a width of between 30 and 50 millimetres and a length between 70 and 90 millimetres.

The above description of embodiments of the present invention is provided for purposes of description to one of ordinary skill in the art. It is not intended to be exhaustive nor to limit the invention to a single disclosed embodiment. It should be appreciated that various changes and modifications may be made to the embodiments described herein without departing from the spirit or scope of the invention. Accordingly, this invention is intended to embrace all alternatives, modifications and variations of the present invention that have been discussed herein, and other embodiments that fall within the spirit and scope of the above described. invention.

Future patent applications may be filed in Australia or overseas on the basis of or claiming priority from the present application. It is to be understood that the following provisional claims are provided by way of example only, and are not intended to limit the scope of what may be claimed in any such future application. Features may be added to or omitted from the provisional claims at a later date so as to further define or re-define the invention or inventions.

The invention claimed is:

1. A portable pump comprising:

a brushless electric motor having a drive shaft, the drive shaft connected to a gear assembly to drive a maximum of one single-piston reciprocating air compressor arrangement;

the single-piston reciprocating air compressor arrangement comprising: a crank that drives a connecting rod and a piston within a cylinder, the connecting rod having a first end and a second end, said first end of the rod connected to the crank and said second end of the rod connected to the piston to drive the piston in the cylinder and provide compression; said piston comprising a sealing arrangement; and wherein the second end of the connecting rod is pivotally connected to the piston via a pin, such that the connecting rod is pivotable relative to the piston;

the gear assembly comprising meshing first and second gears, the crank being coaxially connected by a connection shaft to the first gear such that the crank and the first gear rotate about a common axis, and the second gear being coaxially connected to the drive shaft of the brushless electric motor;

a control unit in electrical communication with the electric motor and the single-piston reciprocating air compressor arrangement to control the operation of the portable pump;

a power supply in electrical communication with the control unit to supply power to the control unit and electric motor;

the electric motor, the gear assembly, the single-piston reciprocating air compressor arrangement, the control unit and the power supply each contained within a portable pump housing; and an outlet connected to the single-piston reciprocating air compressor arrangement so as to engage with an object to be pumped;

wherein the portable pump housing is made from highly thermally conductive metallic material, wherein the portable pump housing is in contact with a portion of the single-piston reciprocating air compressor arrangement thereby acting as a heat sink, and wherein the power supply is a rechargeable battery.

2. The portable pump of claim 1, wherein the sealing arrangement comprises an upper compression seal and a lower stabilizing seal.

3. The portable pump of claim 2, wherein at least one of the seals are cup shaped.

4. The portable pump of claim 1, wherein the connecting rod has a length L and the stroke angle has a value δ, the length L ranging from 20-30 mm and a corresponding stroke angle ranging from 10-20 degrees.

5. The portable pump of claim 1, wherein the electric motor is a brushless DC motor.

6. The portable pump of claim 1, wherein the common housing is made from high strength material.

7. The portable pump of claim 1, wherein the single-piston reciprocating air compressor arrangement comprises a temperature sensor electrically connected to the control unit, the control unit monitoring the temperature of the single-piston reciprocating air compressor arrangement and shutting off power to the pump in the event a predetermined temperature value is exceeded.

8. The portable pump of claim 1, wherein the single-piston reciprocating air compressor arrangement comprises a pressure sensor electrically connected to the control unit, the control unit monitoring the pressure of the single-piston reciprocating air compressor arrangement and shutting off power to the pump in the event a predetermined pressure value is exceeded.

9. The portable pump of claim 1, wherein the housing is made from highly thermally conductive metallic material comprising aluminium, copper, magnesium or steel.

10. The portable pump of claim 1, wherein the air compressor arrangement comprises a surface in abutting contact with a complementary surface provided on an inner wall of the housing.

11. The portable pump of claim 10, wherein the air compressor arrangement comprises a compressor head portion, the compressor head portion comprising the surface in abutting contact with the complementary surface provided on the inner wall of the housing.

12. The portable pump of claim 10, wherein the surface of the compressor head portion and the complementary surface provided on the inner wall of the housing are both substantially planar or curved.

13. The portable pump of claim 12, wherein the surface of the compressor head portion and the complementary surface provided on the inner wall of the housing are both substantially planar, with the surface of the compressor head portion and the complementary surface both orientated in a substantially transverse direction to the direction of movement of the piston in the cylinder.

14. The portable pump of claim 11, wherein the surface of the compressor head portion is mounted directly to the complementary surface provided on the inner wall of the housing.

* * * * *